US009549583B2

(12) United States Patent
Pietrzak et al.

(10) Patent No.: US 9,549,583 B2
(45) Date of Patent: Jan. 24, 2017

(54) HELMET WITH INTEGRATED ELECTRONIC COMPONENTS

(71) Applicant: Bell Sports, Inc., Scotts Valley, CA (US)

(72) Inventors: Christopher T. Pietrzak, Scotts Valley, CA (US); Scott R. Allen, Scotts Valley, CA (US); Joseph D. Tomascheski, Santa Clara, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 0 days.

(21) Appl. No.: 14/146,597

(22) Filed: Jan. 2, 2014

(65) Prior Publication Data

US 2014/0189937 A1 Jul. 10, 2014

Related U.S. Application Data

(60) Provisional application No. 61/749,033, filed on Jan. 4, 2013.

(51) Int. Cl.

| | |
|---|---|
| ***A42B 3/00*** | (2006.01) |
| ***A42B 3/04*** | (2006.01) |
| ***A42B 3/06*** | (2006.01) |

(52) U.S. Cl.

CPC ..... *A42B 3/042* (2013.01); *A42B 3/062* (2013.01)

(58) Field of Classification Search

CPC ..... A42B 3/00; A42B 3/042; A42B 3/0426; A42B 3/044; A42B 3/30; A42B 3/0433; A42B 3/062

USPC ..... 2/411, 425, 410; 345/8

See application file for complete search history.

(56) References Cited

U.S. PATENT DOCUMENTS

| | | | | |
|---|---|---|---|---|
| 4,786,966 | A | 11/1988 | Hanson et al. | |
| 4,970,589 | A | 11/1990 | Hanson et al. | |
| 5,035,474 | A | 7/1991 | Moss et al. | |
| 5,089,914 | A * | 2/1992 | Prescott | 359/815 |
| 5,309,576 | A | 5/1994 | Broersma | |
| 5,322,245 | A | 6/1994 | Bassick | |
| 5,584,073 | A | 12/1996 | Radzelovage et al. | |
| 5,743,621 | A * | 4/1998 | Mantha et al. | 362/105 |

(Continued)

FOREIGN PATENT DOCUMENTS

| | | | |
|---|---|---|---|
| CN | 101710226 | A | 5/2010 |
| DE | 19542835 | A1 | 5/1997 |

(Continued)

*Primary Examiner* — Clinton T Ostrup
*Assistant Examiner* — Abby Spatz
(74) *Attorney, Agent, or Firm* — Booth Udall Fuller, PLC

(57) ABSTRACT

A helmet that can include a helmet body comprising an energy absorption layer and an outer shell. A first opening can be formed through the outer shell and extend into the energy absorbing layer, the first opening including a perimeter. A first sleeve can be disposed at least partially within the first opening, the first sleeve including a first end including a first flange coupled to the outer shell and extending beyond the perimeter of the first opening, and a second end opposite the first end including a base disposed over the energy absorption layer. A camera can be coupled to the first sleeve and exposed through the first opening. The helmet can further include the first sleeve including a depth greater than a width or a length. The first flange can be directly coupled to an outer surface or an inner of the outer shell.

7 Claims, 10 Drawing Sheets

(56) References Cited

U.S. PATENT DOCUMENTS

| | | | | |
|---|---|---|---|---|
| 6,016,160 | A | 1/2000 | Coombs et al. | |
| 6,023,288 | A | 2/2000 | Coombs et al. | |
| 6,292,213 | B1 | 9/2001 | Jones | |
| 6,342,915 | B1 | 1/2002 | Ozaki et al. | |
| 6,476,391 | B1 | 11/2002 | Zhang | |
| 6,606,114 | B1 | 8/2003 | Gordon et al. | |
| 6,704,044 | B1 | 3/2004 | Foster et al. | |
| 6,859,327 | B2 | 2/2005 | Del Bianco et al. | |
| 7,095,025 | B2 | 8/2006 | Reilly et al. | |
| 7,105,796 | B2 | 9/2006 | Lewis et al. | |
| 7,128,434 | B1 * | 10/2006 | Nally et al. | 362/105 |
| 7,170,058 | B2 | 1/2007 | Miyano et al. | |
| 7,234,812 | B2 | 6/2007 | Piorkowski et al. | |
| 7,369,174 | B2 | 5/2008 | Olita et al. | |
| 7,460,304 | B1 | 12/2008 | Epstein et al. | |
| 7,524,153 | B2 * | 4/2009 | Hoy | F16B 37/122 411/108 |
| 7,570,301 | B2 | 8/2009 | Gilor | |
| 7,576,800 | B2 | 8/2009 | Swain | |
| 7,598,928 | B1 | 10/2009 | Buskop | |
| 7,679,670 | B2 | 3/2010 | Tsai | |
| 8,001,623 | B2 | 8/2011 | Gertsch et al. | |
| 8,009,229 | B1 | 8/2011 | Peterson | |
| 8,120,651 | B2 | 2/2012 | Ennis | |
| 8,156,574 | B2 | 4/2012 | Stokes et al. | |
| 8,279,277 | B2 | 10/2012 | Nam et al. | |
| 8,531,592 | B2 | 9/2013 | Teetzel et al. | |
| 2002/0053101 | A1 | 5/2002 | Slack | |
| 2002/0186180 | A1 | 12/2002 | Duda | |
| 2003/0025792 | A1 | 2/2003 | Eberhard | |
| 2003/0221245 | A1 * | 12/2003 | Lee et al. | 2/412 |
| 2005/0060793 | A1 | 3/2005 | MacPherson | |
| 2005/0201740 | A1 | 9/2005 | Pakalns et al. | |
| 2007/0022520 | A1 | 2/2007 | Grassl et al. | |
| 2007/0271687 | A1 * | 11/2007 | Zhou | 2/410 |
| 2008/0052808 | A1 * | 3/2008 | Leick et al. | 2/411 |
| 2008/0068825 | A1 | 3/2008 | Harris | |
| 2008/0131106 | A1 | 6/2008 | Bruce | |
| 2008/0239080 | A1 | 10/2008 | Moscato | |
| 2009/0059063 | A1 | 3/2009 | Gallagher | |
| 2010/0302356 | A1 | 12/2010 | Sinivaara | |
| 2011/0261176 | A1 | 10/2011 | Monaghan, Sr. et al. | |
| 2012/0050607 | A1 | 3/2012 | Sims et al. | |
| 2012/0198603 | A1 | 8/2012 | Gertsch et al. | |
| 2012/0249797 | A1 | 10/2012 | Haddick et al. | |
| 2013/0128046 | A1 | 5/2013 | Gindin | |
| 2014/0075655 | A1 | 3/2014 | Ratner et al. | |

FOREIGN PATENT DOCUMENTS

| | | | |
|---|---|---|---|
| EP | 475679 | A | 3/1992 |
| EP | 622030 | | 11/1994 |
| EP | 1300716 | A1 | 4/2003 |
| EP | 1791365 | A1 | 5/2007 |
| EP | 2082656 | A1 | 7/2009 |
| GB | 2251780 | A | 7/1992 |
| GB | 2299744 | A | 10/1996 |
| WO | 2009079656 | A2 | 6/2009 |
| WO | 2011100284 | A2 | 8/2011 |

* cited by examiner

HELMET WITH INTEGRATED ELECTRONIC COMPONENTS

RELATED APPLICATIONS

This application claims the benefit of U.S. provisional patent application 61/749,033, filed Jan. 4, 2013 titled "Helmet with Integrated Electronic Components," the disclosure of which is hereby incorporated in its entirety by this reference.

TECHNICAL FIELD

The disclosure relates to a protective helmet, and more particularly to a protective helmet having a plurality of integrated electronic components, including but not limited to a camera, a microphone, speakers, a user input device, a data port, and a controller.

BACKGROUND

A physical impact to the head of a person may cause serious injury or death. To reduce the probability of such consequences, protective gear, such as a helmet, is often used in activities that are associated with an increased level of risk for a head injury. Examples of such activities include, but are not limited to, skiing, snowboarding, sledding, ice skating, bicycling, rollerblading, rock climbing, skate boarding, motorcycling, and other motorsports. In general, a helmet is designed to maintain its structural integrity and stay secured to the head of a wearer during an impact.

With increasing frequency, users are capturing "on board" footage of their activities by attaching video cameras to helmets and other equipment. Typically such cameras are attached by first attaching a bracket to the helmet using adhesive, suction cups, or other methods, and then attaching the camera to the bracket. Such installations can be problematic because the camera and the bracket typically project awkwardly from the helmet. As a result, the camera is highly susceptible to damage from impacts, may cause unwanted aerodynamic drag, and may reduce the stability of the helmet by locating a relatively large mass a relatively large distance from the center of rotation of the helmet.

SUMMARY

A need exists for an improved helmet comprising integrated electronic components. Accordingly, in an aspect, a helmet can comprise a helmet body comprising an energy absorption layer and an outer shell. A first opening can be formed through the outer shell and extend into the energy absorbing layer, the first opening comprising a perimeter. A first sleeve can be disposed at least partially within the first opening, the first sleeve comprising a first end comprising a first flange coupled to the outer shell and extending beyond the perimeter of the first opening, and a second end opposite the first end comprising a base disposed over the energy absorption layer. A camera can be coupled to the first sleeve and exposed through the first opening.

The helmet can further comprise the first sleeve comprising a depth greater than a width or a length. The first flange can be directly coupled to an outer surface or an inner of the outer shell. The outer shell and the first sleeve can be formed of a single integrally formed piece. The first sleeve can be configured to dissipate energy from an impact sustained by the camera, the first sleeve comprising an outer surface configured to be in contact with an area of the energy absorbing layer, a size and a shape of the area selected to dissipate the energy from the impact by deforming the energy absorption layer without the outer surface of the first sleeve breaking through the energy absorbing layer. The energy absorbing layer can comprise a thickness in a range of 10-50 millimeters. The outer surface of the first sleeve comprises a second flange embedded in the energy absorbing layer.

In another aspect, a helmet can comprise a helmet body. A first opening can comprise a perimeter and can be formed in the helmet body. A first sleeve can be disposed at least partially within the first opening, the first sleeve comprising a first flange coupled to the helmet body and extending beyond the perimeter of the first opening. A first electronic module can be coupled to the first sleeve and exposed through the first opening.

The helmet can further comprise the first sleeve comprising a depth greater than a width or a length. The first sleeve can be configured to dissipate energy from an impact sustained by the first electronic module, the first sleeve comprising an outer surface configured to be in contact with an area of the helmet body, a size and a shape of the area selected to dissipate the energy from the impact by deforming an energy absorption layer of the helmet body without the outer surface of the first sleeve breaking through the energy absorbing layer. The helmet body can comprise an outer shell comprising a thickness in a range of 0.7-15 millimeters. The first flange can extend beyond the perimeter of the first opening and overlap the outer shell by a distance in a range of 0.5-30 millimeters. The helmet can further comprise a second opening formed through the outer shell, a second sleeve disposed at least partially within the second opening, and a second electronic module disposed within the second sleeve and configured to be in communication with the camera.

In another aspect, a helmet can comprise a helmet body. A first opening can be formed in the helmet body. A sleeve can be disposed at least partially within the opening, the sleeve comprising a depth greater than a length or width and a flange coupled to the helmet body. A camera can be disposed within the sleeve and exposed through the first opening.

The helmet can further comprise the helmet body comprising an outer shell and an energy absorption layer, wherein both the flange and a base of the sleeve contact the energy absorption layer. The sleeve can be configured to dissipate energy from an impact sustained by the camera, the sleeve comprising an outer surface configured to be in contact with an area of the helmet body, a size and a shape of the area selected to dissipate the energy from the impact by deforming an energy absorption layer of the helmet body without the outer surface of the sleeve breaking through the energy absorbing layer. The energy absorbing layer can comprise a thickness in a range of 10-50 millimeters. The outer surface of the sleeve can comprise an additional flange embedded in the energy absorbing layer. The flange can be coupled to an outer shell of the helmet body. The flange can extend beyond a perimeter of the opening and overlap the outer shell by a distance in a range of 0.5-30 millimeters.

BRIEF DESCRIPTION OF THE DRAWINGS

The disclosure will now be described by way of example, with reference to the accompanying drawings.

DETAILED DESCRIPTION

Figure 1A:
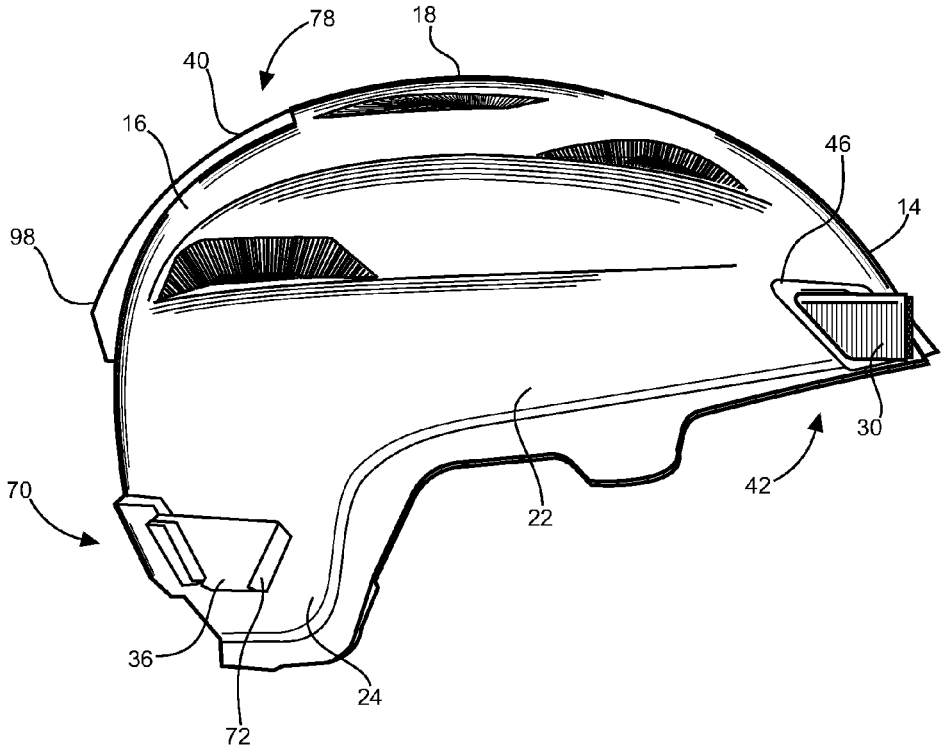
FIGS. 1A-1E include front, right, back, top, and bottom views of a first helmet having a plurality of integrated electronic components.
Figure 1B:
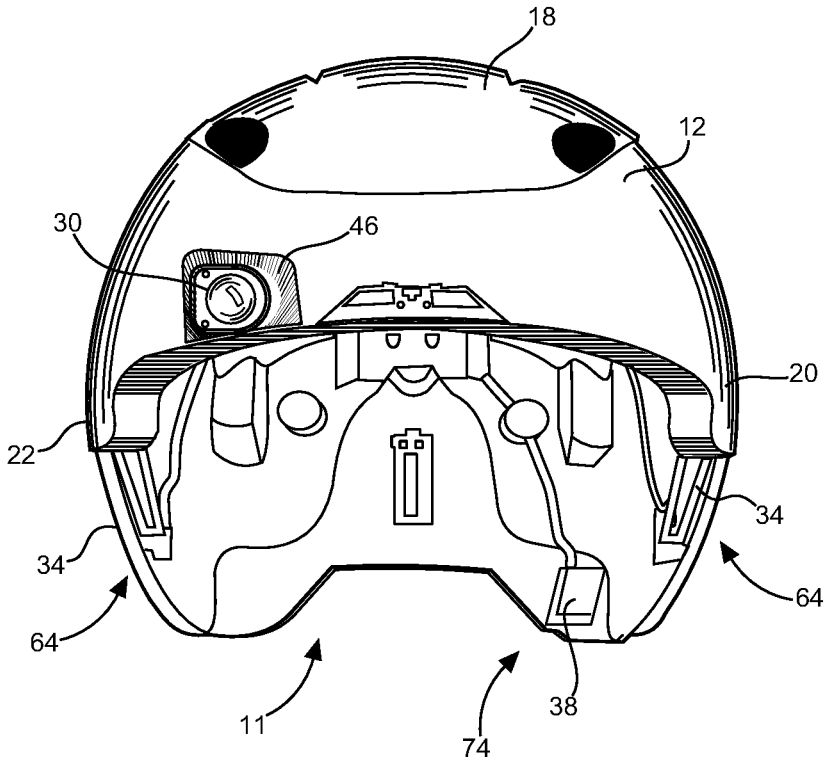
Figure 1C:
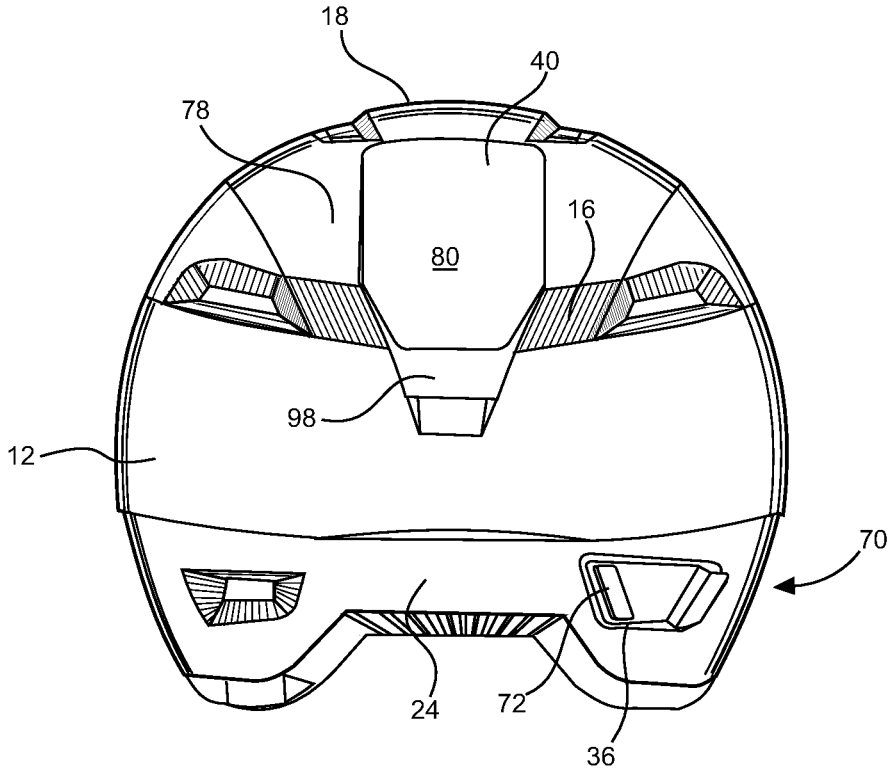
Figure 1D:
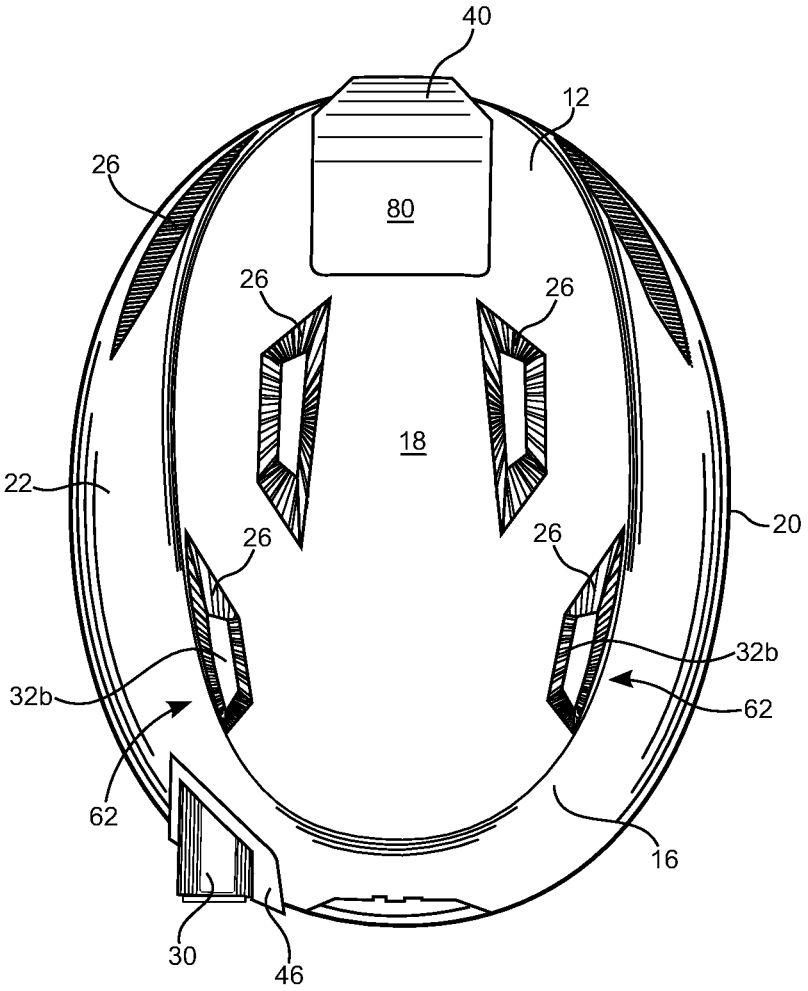
Figure 1E:
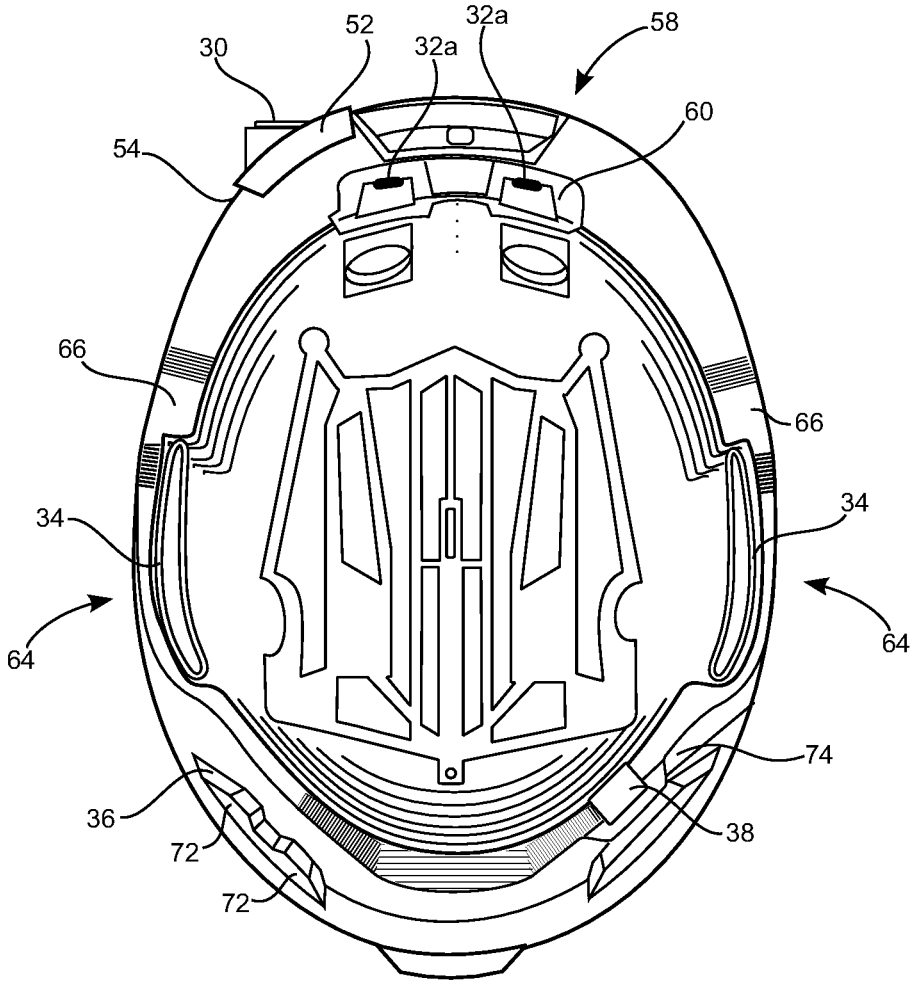

This disclosure, its aspects and implementations, are not limited to the specific helmet or material types, or other system component examples, or methods disclosed herein. Many additional components, manufacturing and assembly procedures known in the art consistent with helmet manufacture are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

While disclosed subject matter is susceptible of embodiments in many different forms, there is shown in the drawings and will herein be described in detail exemplary embodiments with the understanding that the present disclosure is not intended to limit the broad aspect of the inventions as set forth in the claims.

This disclosure provides a system and method for providing a protective helmet for a customer's head with integrated electronic component, such as a helmet for a cyclist, football player, hockey player, baseball player, lacrosse player, polo player, climber, auto racer, motorcycle rider, motocross racer, skier, snowboarder or other snow or water athlete, sky diver or any other athlete in a sport or other person who is in need of protective head gear. Each of these sports uses a helmet that includes either single or multi-impact rated protective material base that is typically, though not always, covered on the outside by a decorative cover and includes comfort material on at least portions of the inside, usually in the form of padding. Other sports, such as boxing sparring, wrestling, and water polo use soft helmet types that can also include integrated electronic components. Other industries also use protective headwear, such as a construction, soldier, fire fighter, pilot, or other worker in need of a safety helmet, where similar technologies and methods may also be applied. The method, system, and devices described herein are discussed with particular reference to heads and helmets, the same or similar methods, systems, and devices are applicable to other body parts and corresponding gear or clothing.

In the Figures, and referring initially to FIGS. 1A-3B and FIG. 5, an embodiment of a helmet 10 is shown. Helmet 10 can include a helmet body 12 that includes a front portion 14, a rear portion 16, a crown portion 18, a left side portion 20, a right side portion 22, and an occipital portion 24 extending generally downwardly from the rear portion 16, which can be secured to the head of a wearer. In the illustrated construction, the body 12 includes a plurality of ventilation openings 26. Helmet body 12 may be of unitary or composite construction, and may include, among other things, multiple layers including a relatively hard, impact resistant outer shell 12*a*, an energy absorbing layer or attenuating liner 12*b* and a comfort liner 12*c*. As a non-limiting example, outer shell 12*a* can include a thickness in a range of 0.7-15 millimeters (mm). Energy absorbing layer 12*b* can be formed of one or more layers of energy absorbing material such as expanded polystyrene (EPS), expanded polypropylene (EPP), or other suitable material. In an embodiment, energy absorbing layer 12*b* comprises EPS further comprising an thickness in a range of 10-50 mm. Energy absorbing layer 12*b* can extend along an inner surface of outer shell 12*a*, a padding layer or comfort liner 12*c* can extend along an inner surface of the energy absorbing layer 12*b*, and a fit system can be coupled to one, some, or all of the outer shell, the energy absorbing layer, and the comfort liner. It should be appreciated that the helmet 10 may include different combinations of layers, different materials, and different construction methods and techniques without departing from the spirit and scope of the present inventions.

The helmet 10 also includes a system 11 comprising a plurality of electronic components integrated into the construction of the body 12. As a non-limiting example, helmet 10 can include one or more forward- or other-facing camera (s) or electronic module(s) 30, one or more interior microphones 32*a*, one or more exterior microphones 32*b*, one or more, i.e. left and right, speakers 34, a user input device 36, a data port 38, and a controller 40 electronically communicating with each of the foregoing electronic components. Although not shown, the helmet 10 may also include a display device positioned within the user's field of vision. In some embodiments, the display device may include one or more light emitting diode (LED) light indicators 29 for indicating, among other things, whether the camera 30 is recording. In other embodiments, the display may also or alternatively include a heads up display for displaying, for example, a video feed from the camera, speed, location, and other information, as discussed further below.

To accommodate the electronic components, the body 12 is provided with a plurality of openings, recesses, or "nests" that receive and support the electronic components. Each opening is configured to support and locate its respective electronic component in a manner such that when all electronic components are installed in the helmet 10, the helmet 10 is able to pass the applicable testing standards for the intended end use of the helmet 10. To this end, and as discussed further below, the openings and the electronic components that fit within the openings are uniquely configured and arranged to attenuate and distribute energy from impacts throughout the body 12 of the helmet 10.

The camera 30 is received within an opening or camera nest 42 formed in the front portion 14 of the body 12. It should be appreciated that the camera 30 and camera opening 42 could be relocated, for example to the rear portion 16, to provide a different perspective. It should also be appreciated that more than one camera 30 could be provided for the simultaneous recording of video from multiple perspectives. Camera opening 42, like the other openings and nests described hereafter, can be formed as a recess that extends into helmet body 12. More specifically, camera opening 42 as well as the other openings can be formed completely or partially through any number of the helmet body layers, including outer shell 12*a*, energy absorbing layer 12*b*, and padding layer 12*c*. The recess receives a sleeve, load dissipating member, or parachute 46 to which the camera 30 is coupled.

Sleeve 46 comprises a shockproofing device that can be formed of a yielding, springlike support that can deformably and elastically absorb energy or a force transferred to helmet 10 during an impact or during contact with another object. Sleeve 46 can substantially maintain its shape and preserve a space or shape of camera opening 42 into which camera 30 placed, coupled, or mounted. The camera is coupled to the first sleeve and exposed through the first opening at a front of the helmet, offset from a longitudinal central axis of the helmet.

Sleeve 46 includes a main body portion 48 that fits within the recess, and a flange portion 50 that extends generally outwardly from a perimeter of the recess. The flange portion 50 also includes a tab portion 52 that extends around a lower edge 54 of the front portion 14 of the body 12. The flange portion 50 of sleeve 46 is adapted to mate closely against the outer surfaces of the front portion 14 of the body 12. In this way, forces from an impact to the camera 30 can be distributed over a greater portion of the body 12 for better energy attenuation. Optionally, a cover or shroud 47 can be placed around sleeve 46 and camera 30 to close off any gaps or openings that might exist between camera 30, 46, and helmet body 12.

The interior microphones 32*a* are received within at least one interior opening or microphone nest 58. In the illustrated embodiment, a single interior microphone opening 58 is provided in the front portion 14 of the body 12, and the individual interior microphones 32*a* are mounted to a housing 60 that is received by the opening 58. In other embodiments, there may be more than one interior microphone opening 58 and the interior microphones 32*a* may be individually positioned within a respective opening 58. The interior microphones 32*a* may be directional microphones and may be configured and arranged primarily to detect sounds originating from the user's mouth. In the illustrated embodiment, the exterior microphones 32*b* are each received within a respective opening or exterior microphone nest 62 located generally at the intersection of the front portion 14, the crown portion 18, and the left and right side portions 20, 22. Each exterior microphone 32*b* is also positioned adjacent to or otherwise associated with a respective one of the ventilation openings 26. In other embodiments, the exterior microphone opening or openings 62 may be separate from the ventilation openings 26, if any. The exterior microphones 32*b* may be configured and arranged primarily to detect sounds originating from the user's surroundings. Both the interior microphones 32*a* and the exterior microphones 32*b* may be covered with suitable windscreens to reduce wind noise.

The left and right speakers 34 are positioned in or adjacent to the respective left and right side portions 20, 22 of the body 12. In some embodiments, including the embodiment of FIG. 1, the left and right speakers 34 may be received within respective left and right openings or speaker nests 64 formed in generally downwardly facing left and right bottom surfaces 66 of the left and right side portions 20, 22. In other embodiments, the left and right speakers 34 may be coupled to or carried by an ear flap 68 formed as part of the comfort layer and extending downwardly from the left and right side portions 20 and 22, respectively. In the illustrated embodiment the ear flap 68 may be provided to protect and provide warmth for the user's ears.

In the illustrated configuration, the user input device 36 is received by an opening or input device nest 70 positioned on a right-hand side of the occipital portion 24 of the body 12. In other embodiments, the input device 36 may be located elsewhere on the body 12, and the helmet 10 may also include more than one input device 36. The input device 36 may include a combination of manually-operable buttons, switches, dials, touch pads, and the like. Because many activities that traditionally involve the use of a helmet also involve the use of gloves, the input device 36 may be configured with relatively large, easily tactilely detectable buttons 72, switches, or other devices that can be easily manipulated while wearing gloves.

Figure 3A:
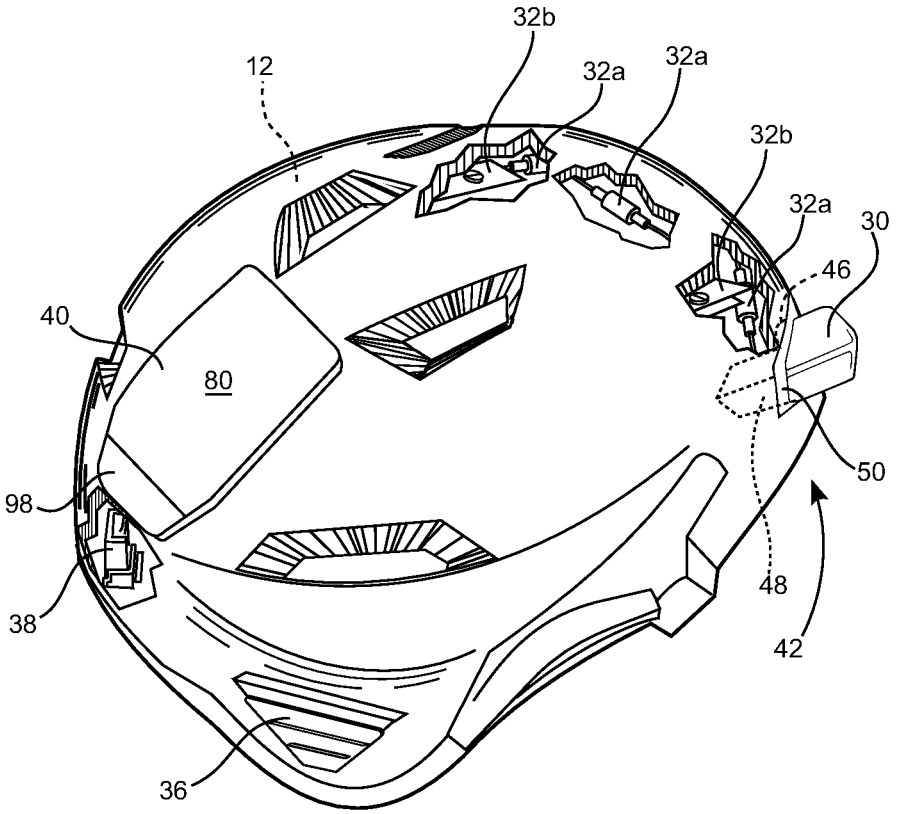
FIGS. 3A-3B include first and second perspective views of the helmet of FIG. 1.
Figure 3B:
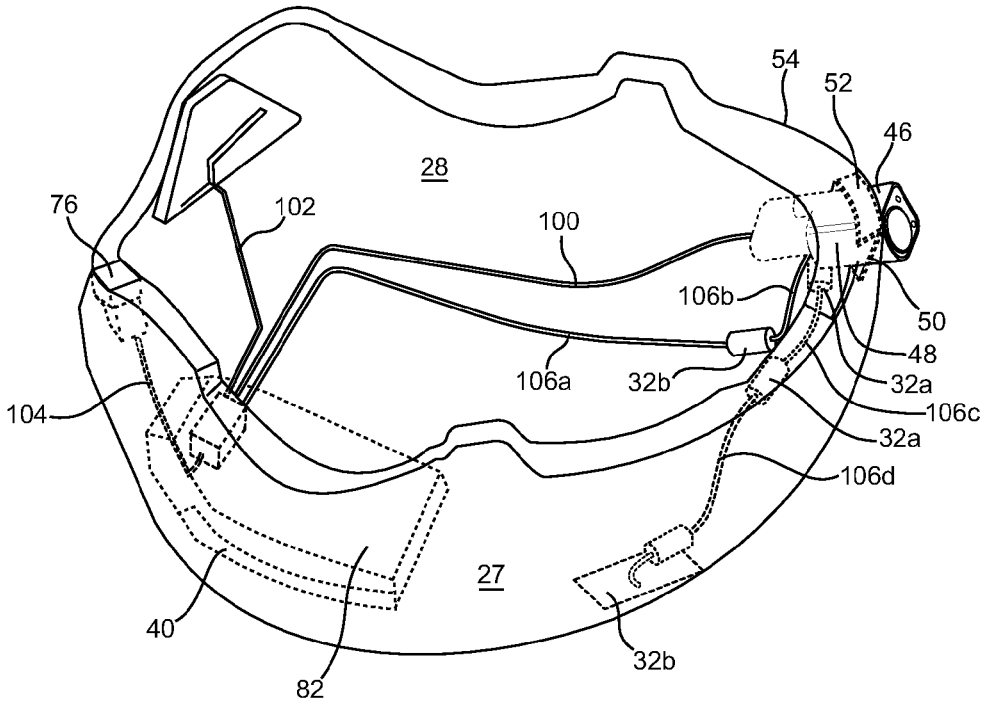

The data port 38 in the illustrated body 12 is located on a left-hand side of the occipital portion 24 of the body 12 and is received by an opening or data port nest 74. The data port 38 is provided to enable wired electronic communication between the helmet 10 and electrical components thereof and an external electronic device, such as a personal computer or smart phone. The data port 38 can be substantially any existing or future connection affording electronic communication using substantially any communication protocol, regardless of whether the particular connection and/or communication protocol are standardized or proprietary. By way of example only, the data port 38 may be a universal serial bus (USB). As best shown in FIG. 3, the data port 38 may include a covering member 76 that can be moved to selectively cover and expose the electrical connector portion of the data port 38. The covering member 76 protects the data port 38 when the data port 38 is not in use (e.g., when the user is participating in a sporting activity) and in some embodiments may be substantially waterproof.

The controller 40 of the illustrated configuration is positioned in an opening or controller nest 78 formed in the rear portion 16 of the body 12. The controller 40 and the controller opening 78 are cooperatively configured such that impacts to the controller 40 are dissipated over a relatively large area. In this regard, the controller 40 is relatively long and wide, but also relatively thin, such that a relatively large outer surface 80 is exposed when the controller 40 is received by the controller opening 78. The controller opening 78 also includes a relatively large flat inner surface 82 (FIGS. 2 and 3) that is mated against the energy attenuating layer of the body 12. Thus, impacts directed against the controller 40 can be distributed over the relatively large surface area of the inner surface 82 of the controller opening 78, thereby improving energy attenuation. Moreover, by configuring the controller 40 and the controller opening 78 to be relatively thin, a greater thickness of energy attenuating material can be provided between the inner surface 82 of the controller opening 78 and the outer surface of the wearer's head.

The controller 40 may include, among other things, a processor, memory, a telemetry module, and a plurality of input, output, and communication modules. The processor may include a plurality of modules capable of interacting with other components of the helmet 10 to perform various helmet functions discussed further below, such as processing photos and videos from the camera 30, performing speech recognition and/or noise reduction based on inputs from the microphones 32*a*, 32*b*, processing audio output signals for the speakers 34, receiving and processing inputs from the input device 36, and communicating with external electronic devices via the data port 38. The memory associated with the controller 40 may include volatile and non-volatile memory, including permanent memory for storing firmware and the like, and removable memory, such as an SD card, for storing user-generated information. The telemetry module may include, among other things, one or more accelerometers, gyros, magnetic compasses, and the like capable of determining relative movement and orientation of the helmet. Output from components of the telemetry module may be recorded in memory for subsequent retrieval and review. Examples of input, output, and communication modules that may be included in the controller 40 include a GPS module, which may work in concert with the telemetry module to determine the location of the helmet 10, an audio input module receiving input from the microphones 32*a*, 32*b*, an audio output module providing audio output to the speakers 34, one or more short-range wireless communication modules, such as a WI-FI™ module and/or a BLUETOOTH™ module for wirelessly communicating with wireless networks and/or with other electronic devices, one or more long-range wireless communication modules for communicating over long-range wireless networks, such as mobile phone cellular networks, and other input and output modules for communicating with the input device and data port, for receiving electrical power from an electrical power supply (such as a battery or accessory power supply), and for distributing electrical power to the other electrical components of the helmet 10. Although the illustrated controller 40 is shown as a single unit, it should be appreciated that the above described components and features of the controller 40 can also be distributed over several individual control units with each control unit located in a different portion of the helmet and communicating via wired or wireless connections with the other control units and components of the helmet 10. Thus, although referred to herein as a singular "controller 40," the controller 40 may include multiple distributed components.

Figure 2:
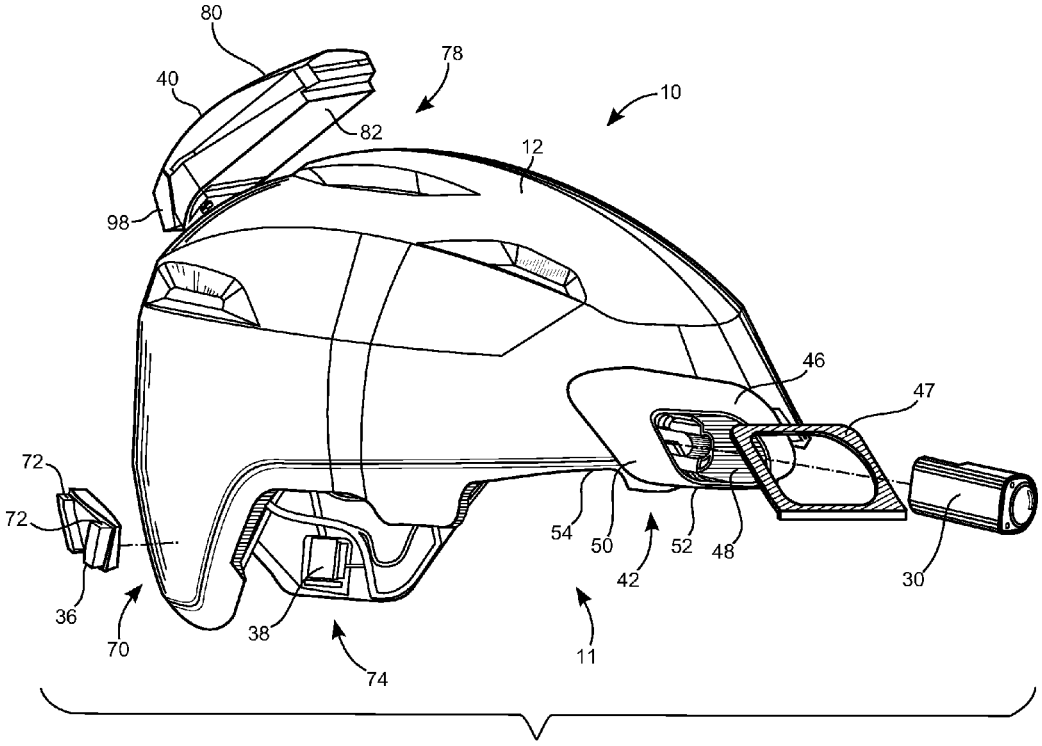
FIG. 2 shows an exploded view of the helmet of FIG. 1A.

As best shown in FIGS. 2 and 3, the controller opening 78 may be or include a docking member 98 by which the controller 40 may be physically and electrically coupled to the helmet 10. The docking member 98 may be provided with physical and electrical coupling elements that releasably couple the controller 40 to the helmet 10. The docking member 98 is in electrical communication with each of the electrical components of the helmet 10, including, for example, the camera 30, microphones 32*a*, 32*b*, speakers 34, input device 36, and data port 38. The docking member 98 includes pass-through electronic connections such that coupling the controller 40 to the docking member 98 electrically couples the controller 40 to the camera 30, microphones 32*a*, 32*b*, speakers 34, input device 36, and data port 38. The pass-through electronic connections provided on the docking member 98 may be standardized connections or may be proprietary connections. In some embodiments, an additional stand-alone docking member (not shown) may be provided for electronic coupling to or with a personal computer or other external electronic device. In this way a user can remove the controller 40 from the helmet 10, couple the controller 40 to the stand-alone docking member, and download or upload information from the controller 40 to the personal computer or other external electronic device.

In the illustrated configuration the docking member 98 communicates with the other electronic components of the helmet 10 via wired connections. As shown in FIG. 3, the camera 30 is electrically coupled to the docking member 98 via a camera lead 100, the input device 36 is electrically coupled to the docking member 98 via an input device lead 102, and the data port 38 is electrically coupled to the docking member 98 via a data port lead 104. The microphones 32*a*, 32*b* are electrically connected in a daisy chain arrangement by a plurality of microphone leads 106*a*, 106*b*, 106*c*, 106*d*. The lead 106*a* extends between the docking member 98 and a first of the exterior microphones 32*b*. The lead 106*b* extends between the first exterior microphone 32*b* and a first interior microphone 32*a*. The lead 106*c* extends between the first interior microphone 32*a* and a second interior microphone 32*a*, and the lead 106*d* extends between the second interior microphone 32*a* and a second exterior microphone 32*b*. Although the microphones 32*a*, 32*b* are electrically coupled to docking member 98 via common leads, audio signals from the individual microphones may be kept distinct from one another to allow for stereo audio recording and to isolate audio signals from the interior microphones 32*a* for voice recognition processing. Although not shown, leads are also provided between the docking member 98 and the speakers 34.

The leads 100, 102, 104, and 106*a* through 106*d* may be routed through channels or conduits formed in or between the various helmet layers. For example, in one configuration, the energy attenuating layer of the helmet 10 is formed of EPS. Channels may be formed in the inner surface of the EPS energy attenuating layer to accommodate the various leads. With the leads positioned in the channels, an intermediate layer may be used to cover the channels. The intermediate layer may be secured to the inner surface of the energy attenuating layer and located between the energy attenuating layer and the comfort layer, for example. In other configurations, the channels may be sealed using a suitable adhesive or other bonding method. In still other configurations, the channels may be sufficiently narrow that no special bonding or covering of the channels is required once the leads are positioned in the channels. In embodiments where the speakers 34 are mounted in speaker openings 64 on the left and right side portions 20, 22 of the body 12, the speaker leads (not shown) may extend through channels in the energy attenuating layer. In embodiments where the speakers 34 are mounted to the ear flap 64 of the comfort layer, the leads may extend through the comfort layer or between the comfort layer and the energy attenuating layer. In other configurations, one or more of the other electronic components of the helmet 10 may communicate with the controller 40 wirelessly, thereby eliminating the need for channels in the energy attenuating layer. The module or modules for wirelessly communicating with the other electronic components of the helmet 10 may reside in one or both of the controller and the docking member 98.

Each of the above-described electronic components may be substantially waterproof and impact resistant. Each of the above-described openings or nests may be or include a recess formed in helmet body 12 of helmet 10 and be appropriately configured to receive a sleeve comprising structural inserts such as flanges 50 that fit within or around the recess to secure the sleeve to the helmet as described in greater detail below and with respect to FIGS. 4A-4F. Because FIGS. 4A-4F are non-limiting examples of how a sleeve, such as sleeve 46, can be configured within helmet 10 to receive an electronic module such as camera 30, a controller 40, an input device 36, or any other electronic device, a person of ordinary skill in the art will understand that any number of sleeves can be configured in a variety of ways for housing any number of electronic modules within helmet 10 according to the non-limiting examples provided.

Figure 4A:
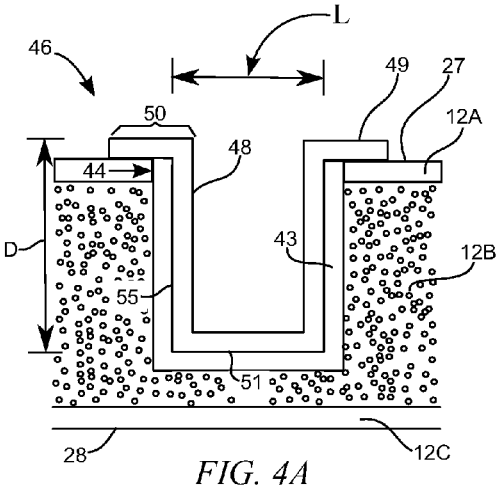
FIGS. 4A-4F show additional detail of a sleeve configured to receive an electronic module such as a camera.

FIG. 4A is cross-sectional view of a portion of helmet 10, the view being centered around sleeve 46 disposed within an opening, recess, or cavity 43 that is formed through helmet body 12 including through outer shell 12*a*, and partially but not completely through energy absorbing layer 12*b*. Opening 43 can extend from an outer surface 27 of helmet body 12 towards an inner surface 28 of helmet body 12. Opening 43 can also have a depth greater than a length or a width of the opening. Opening 43 includes a perimeter or an outer surface 44 that defines a footprint or cross-sectional shape of the opening. Perimeter 44 can be constant or can vary along a depth of the opening. Perimeter 44 at outer surface 27 of helmet body 12 can include any number of shapes including square, rectangular, circular, oval, star, geometric, organic, or any suitable shape.

As shown in FIG. 4A, sleeve 46 is disposed at least partially within opening 43. Sleeve 46 can be removably or permanently coupled to helmet body 12 using chemical bonding such as adhesive or physical bonding that can include hooks, barbs, tabs, detents, snaps, clips, latches, magnets, and the like, to assist in securing and locating sleeve 46 within opening 43. Sleeve 46 can include a first end 49 that comprises a flange portion 50 as well as a second end 51 opposite the first end that comprises a base 53. Base 53 can be coupled to energy absorbing layer 12*b* through one or more intermediary layers and can also be in direct contact with the energy absorbing layer. As illustrated in FIG. 4A, base 53 can also be suspended within opening 43 so that a space or gap separates base 53 from energy absorbing layer 12*b* and an outer surface 55 of sleeve 46, including base 53, is not in direct contact with the energy absorbing layer. In either case, sleeve 46 can comprise a depth, or distance between first end 49 and second end 51, which is greater than a width or a length of the sleeve, wherein the width or length of the sleeve can be measured as a distance that extends between outer surface 55 of main body portion 48 of sleeve 46. By providing sleeve 46 with a depth greater than a length or a width, the sleeve can contain electronic modules such as camera 30, that also comprise a depth greater than a length or width. Advantageously, increasing a depth of electronic modules, such as camera 30, can increase module functionality such as permitting a greater focal length for the camera. While conventional helmets have avoided imbedding electronic modules comprising a depth greater than a length or width within the helmet, and within an energy absorbing layer, use of sleeve 46, as described in greater detail below, allows such electronic modules to be safely contained within the helmet.

As shown in FIG. 4A, sleeve 46 can be coupled to helmet body 12 by coupling or directly attaching flange 50 to outer shell 12*a*. Flanges 50 can be planar, flat, inclined, circular, square, rectangular, or of another shape, size, or position according to the configuration and design of helmet 10 and sleeve 46. Flange 50 can be coupled to either an outer surface of outer shell 12*a*, which can be co-extensive with outer surface 27 of helmet body 12, or can be coupled to an inner surface of the outer shell that is opposite the outer surface of the outer shell. Alternatively, flange 50, and indeed all of sleeve 46, can be integrally formed as part of a single or unitary component with outer shell 12*a*. As shown in FIG. 4A, flange 50 can extend beyond perimeter 44 of opening 43 and overlap outer shell 12*b*. In an embodiment, flange 50 can overlap outer shell 12*b* by a distance of 0.5-30 mm.

Sleeve 46 is configured to dissipate energy from an impact sustained by camera 30 without an outer surface 55 of the sleeve breaking through energy absorbing layer 12*b*. Outer surface 55 of sleeve 46 can comprise an area configured to be in contact with the energy absorbing layer 12*b*, a size and a shape of the area selected to dissipate the energy from the impact by deforming the energy absorption layer. For example, the portion of flanges 50 disposed outside perimeter 44 of opening 43 as well as base 53 of sleeve 46 can transfer energy from an impact with camera 30, or other electronic module, to the energy absorbing layer in such a way as to prevent camera 30 from contacting a wearer's head, and to prevent sleeve 46 from breaking through energy absorbing layer 12*b* to contact the wearer's head. Contact of sleeve 46 and camera 30 with the wearer's head during impact of camera 30 with an object external to the helmet can be facilitated by adjusting a design of the size and shape of sleeve 46. The design of sleeve 46 can be adjusted to include differing numbers and surface area of flanges 50 and an area of base 53 in relation to the properties of helmet body 12, including, for example, a density, stiffness, and general deformablity of energy absorbing layer 12*b*.

Helmet body 12, including a plurality of openings and sleeves disposed within the helmet body, can be configured such that regardless of whether electronic modules are disposed within the sleeves, helmet 10 is able to pass the applicable testing standards for the intended end use of the helmet. As shown and discussed in relation to FIGS. 1A-3B and FIG. 5, multiple openings can be formed completely or partially through outer shell 12*a* and energy absorbing layer 12*b*. Additionally, multiple sleeves can be disposed at least partially within the plurality of openings, and the plurality of openings can be configured to be in communication with each other and provide a system of increased functionality for integrating features of sight, sound, and other information.

Figure 4B:
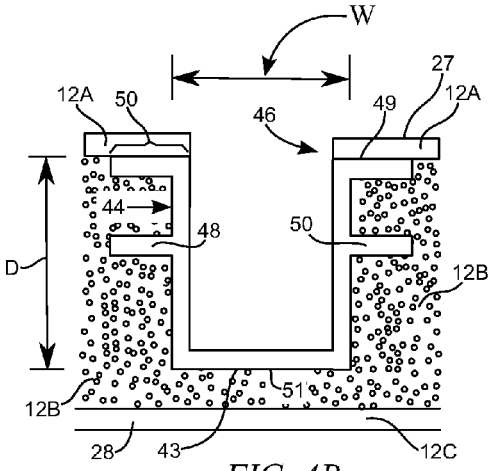

FIG. 4B is a cross-sectional view of a portion of helmet 10, similar to the view shown in FIG. 4A. FIG. 4B shows a portion of helmet 10 centered around an embodiment of sleeve 46 disposed within opening 43. Opening 43 is shown formed in helmet body 12 and extending through outer shell 12*a* and partially but not completely through energy absorbing layer 12*b*. Opening 43 can extend from outer surface 27 of helmet body 12 towards inner surface 28 of helmet body 12. Opening 43 can also have a depth greater than a length or a width of the opening. Opening 43 includes a perimeter or an outer surface 44 that contacts outer surface 55 of main body portion 48 of sleeve 46, including base 53. Perimeter 44 of opening 43 can contact and follow a contour of sleeve 46.

As shown in FIG. 4B, sleeve 46 can be disposed within opening 43 so that flanges 50, base 53, and outer surface 55 of the sleeve directly contact energy absorbing layer 12*b*. Forming sleeve 46 in direct contact with energy absorbing layer 12*b* can be accomplished for forming or injecting energy absorbing layer 12*b* around sleeve 46, or by inserting sleeve 46 into a preformed energy absorbing layer, such as when the energy absorbing layer is already formed as part of helmet body 12. In either case, sleeve 46 can comprise a depth D, or distance between first end 49 and second end 51, which is greater than a width W or a length L of the sleeve, wherein the width or length of the sleeve can be measured as a distance that extends between opposing portions of outer surface 55 of main body portion 48 of sleeve 46.

As shown in FIG. 4A, sleeve 46 can be coupled to helmet body 12 by coupling or directly attaching flanges 50 at first end 49 to an inner surface of outer shell 12*a*. Additional flanges can be coupled to helmet body 12 away from outer shell 12*a* and can be embedded within energy absorbing layer 12B. Flanges 50 can extend beyond perimeter 44 of opening 43 and overlap, or extend beyond a footprint of, outer shell 12*b*. In an embodiment, flanges 50 can overlap outer shell 12*b* by a distance of 0.5-30 mm.

Figure 4C:
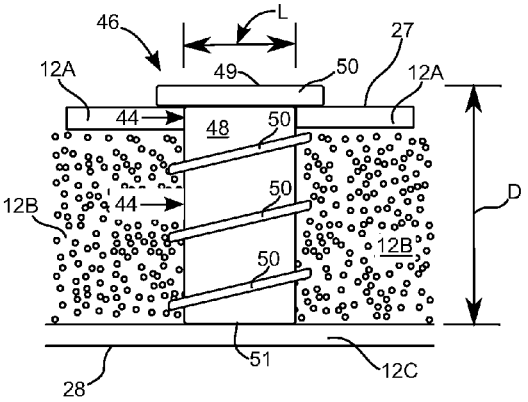

FIG. 4C is a cross-sectional view of a portion of helmet 10, similar to the view shown in FIG. 4B. FIG. 4C shows a portion of helmet 10 centered around an embodiment of sleeve 46 disposed within opening 43. Opening 43 is shown formed in helmet body 12 and extending through outer shell 12*a* and completely through energy absorbing layer 12*b*. Opening 43 can also have a depth greater than a length or a width of the opening. Opening 43 includes a perimeter or an outer surface 44 that contacts outer surface 55 of main body portion 48 of sleeve 46. Base 53 can be exposed with respect to energy absorbing layer 12*b*. Perimeter 44 of opening 43 can contact and follow a contour of sleeve 46 and flanges 50. Forming sleeve 46 and flanges 50 in direct contact with energy absorbing layer 12*b* can be accomplished for forming or injecting energy absorbing layer 12*b* around sleeve 46, or by inserting sleeve 46 into a preformed energy absorbing layer, such as when the energy absorbing layer is already formed as part of helmet body 12. FIG. 4C shows flanges 50 formed with sleeve 46 as an incline plane spirally circling around main body portion 48 of the sleeve. Flanges 50 can be formed as a continuous incline plane or as a discontinuous and intermittently spaced incline plane. Advantageously, flanges 50, when arranged as spiral threads, can facilitate sleeve 46 being screwed or rotatably inserted into opening 43. Whether energy absorbing layer 12*b* is formed around sleeve 46, or sleeve 46 is inserted into an already formed energy absorbing layer, sleeve 46 can comprise a depth D that is greater than a width W or a length L of the sleeve. In an embodiment, flanges 50 can overlap outer shell 12*b* by distances in a range of 0.5-30 mm.

Figure 4D:
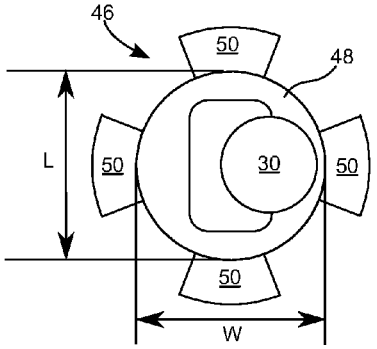

FIG. 4D is a top or plan view of camera 30 disposed within sleeve 46, which can correspond to one or more of the cross-sectional views shown in FIGS. 4A-4C. The plan view of FIG. 4D is perpendicular or transverse to the views shown in FIGS. 4A-4C. FIG. 4D provides an example of a main body portion 48 comprising a cross sectional area that is circular in shape with a number of flanges 50 disposed around outer surface 55 of main body portion 48 of sleeve 46. Flanges 50 can be disposed at a same level, such as at first end 49. Flanges 50 can also be disposed at different levels along a depth D of sleeve 46 (shown into the page), and flanges 50 can also be spirally angled as part of a discontinuous incline plane.

Figure 4E:
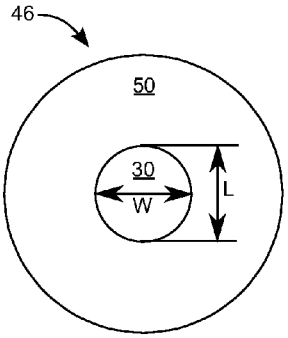

FIG. 4E, similar to FIG. 4C, is a top or plan view of camera 30 disposed within sleeve 46, which can correspond to one or more of the cross-sectional views shown in FIGS. 4A-4C. FIG. 4E differs from FIG. 4D in that flange 50 is shown as a solid or continuous piece rather than as multiple smaller pieces. However, flanges 50 in FIG. 4D, like the flanges of FIG. 4D, can be disposed at different levels along a depth D of sleeve 46 (shown into the page), and can also be spirally angled as part of a continuous incline plane similar to flanges 50 shown in FIG. 4C.

Figure 4F:
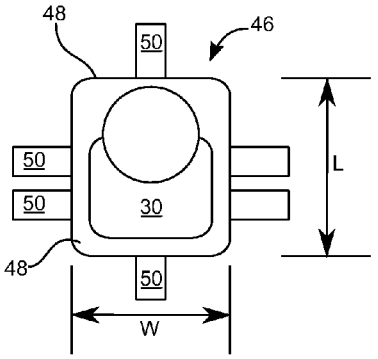
Figure 5:
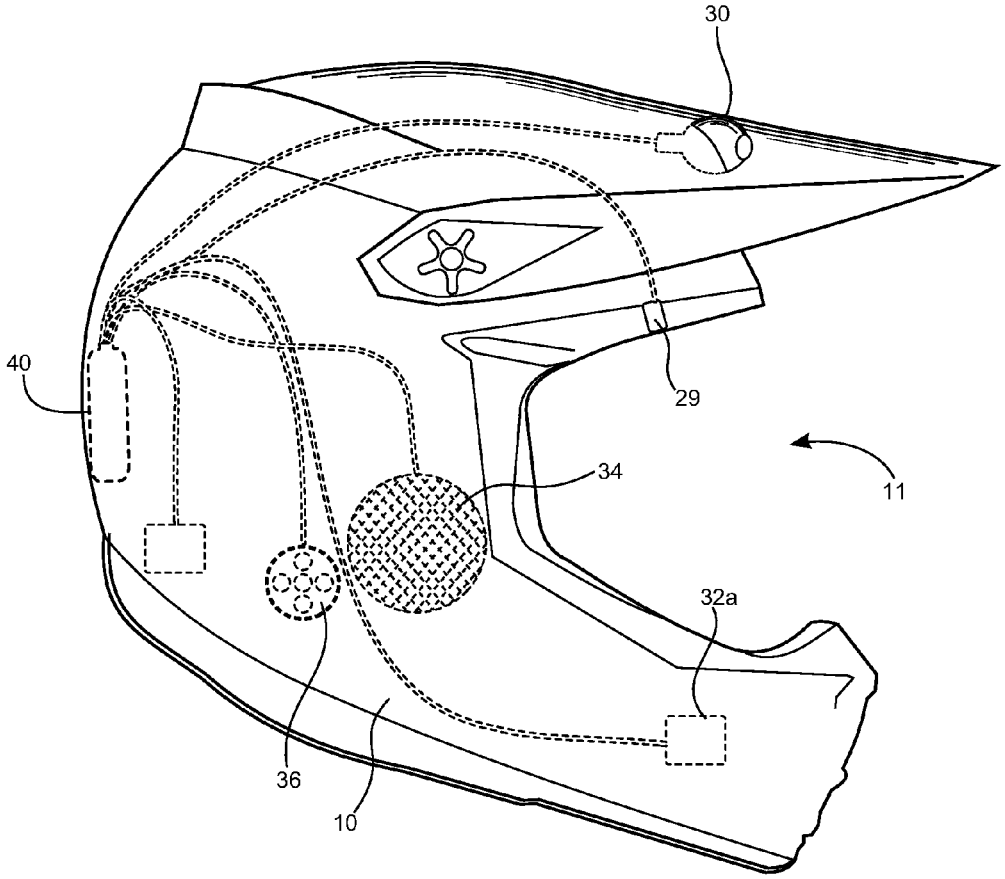
FIG. 5 shows a side view of a second helmet having a plurality of integrated electronic components.

FIG. 4F, similar to FIG. 4C, is a top or plan view of camera 30 disposed within sleeve 46, which can correspond to one or more of the cross-sectional views shown in FIGS. 4A-4C. FIG. 4E differs from FIG. 4D in that main body portion 48 of sleeve 46 comprises a cross-sectional area that is square-shaped with rounded corners rather than circular. Additionally, flanges 50 are shown as elongated rectangular tabs, nobs, or dowels attached on various portions of outer surface 55. Flanges 50 in FIG. 4F can be disposed at different levels along a depth D of sleeve 46 (shown into the page), and can also be spirally angled as part of a discontinuous incline plane similar to flanges 50 shown in FIG. 4D.

Operation and functionality of the system 11 and the components comprising the system 11 will be further explained by setting forth several exemplary operating scenarios. In one exemplary operating scenario, the system 11 enhances the purchasing experience of the helmet 10 at a point of sale. With the helmet 10 positioned on a display, a potential buyer may remove the helmet 10 from the shelf. When shipped from the manufacturer or placed in the sales location, the helmet controller 40 may programmed to operate in a "sales mode." When in sales mode, upon sensing that the helmet 10 has been moved, for example via the accelerometer and/or gyro provided in the telemetry module, the controller 40 may cause the speakers 34 to play a pre-recorded saying such as "try me on!" The speakers 34 may also be used to prompt the potential buyer to command the system 11 to perform various other tasks, thereby actively demonstrating to the potential buyer the various features of the helmet 10.

Once purchased, the user may bring the helmet 10 home and connect the system 11 to the user's personal computer or other personal electronic device for an initial setup. The connection with the user's personal computer may be accomplished in a variety of ways, including through the data port 38, via a stand-alone docking member 98, or wirelessly via one of the short-range or long-range wireless communication modules. In some embodiments, the initial setup may be conducted by providing inputs to the system 11 by way of voice recognition and the input device 36, without connecting to an external electronic device. Initial setup is intended to be a relatively straightforward process that may include, among other things, establishing a user account on a network server providing online storage and communication services for the helmet 10, and/or associating the helmet 10 with an existing personal online account, such as an existing "cloud" storage account, or an existing social networking account. Initial setup may also include uploading music files, playlists, and the like to the controller 40 for storage in memory. The controller 40 may be pre-charged at the point of sale so the user can begin using the helmet 10 and the system 11 immediately, although certain features of the system 11 may not be available if the user does not first complete the initial setup.

Upon an initial use, the helmet 10 may greet the user, possibly by name, and may prompt the user to complete a guided tutorial of various helmet features. Non-automated features and processes of the system 11, i.e., those that the system 11 does not automatically initiate, generally are initiated by voice activation, whereby the controller 40 processes speech audio detected from the internal speakers 32*a*, by manual operation of the input device 36, or by a combination thereof. Thus, for example, a user may instruct the controller 40 to perform a particular function by speaking a command phrase that is interpreted by the voice recognition module provided within the controller 40. The controller 40 may then respond appropriately by sending commands to other components or by wirelessly communicating with external networks via one of the wireless communication modules.

Voice commands that may be recognized by the system 11 can include, for example, commands relating to the playing of audio files saved in memory, commands relating to the recording of video and audio, commands relating to saving recordings of video and audio and/or sending such recordings to external storage locations. In this regard, the system 11 may include a plurality of video modes. In a continuous video mode the wearer may issue a voice command to "start video" or "video on" at which point the controller 40 begins recording video images captured by the camera 30. In continuous video mode, the controller 40 continuously records video until the user issues a voice command such as "stop video" or "video off" to stop the recording. In a memory replay video mode, the controller 40 continuously records and saves video for a specific time period, such as the previous 5 minutes or previous 10 minutes, depending, for example, on the amount of memory available for storing video. During memory replay mode, the controller automatically deletes video that is older than the specified time period. At any time the user may issue a command such as "capture last 5 minutes" and the previous 5 minutes of video will automatically be saved to a separate location and will therefore not be deleted once the specified time period expires. In this way a user can reduce the amount of video editing required after completion of an activity by only saving video of exciting or interesting activities.

Once videos have been saved, the user can issue a command such as "save to cloud" that instructs the controller 40 to upload the video to a cloud storage system by way of one of the wireless communication modules. In some implementations, the system 11 may be linked to a branded website that allows users to upload videos and submit the videos for comments and voting by other helmet users or the online community at large.

The system 11 may also include short-range and/or long-range audio and audio/video communication capabilities similar to that provided by a mobile phone. Short-range communication capabilities may include, among other things, the ability to communicate with users of similar helmets 10, and the ability to communicate over standard radio frequencies. Examples of long-range communication capabilities may include the ability to communicate with mobile phones or land lines via a long range communication network.

The system 11 may also include an emergency mode that may facilitate the arrival of help and/or the locating of the helmet wearer. In one implementation, the wearer may issue a command that indicates the wearer has had an accident and is seeking assistance. In another implementation, the telemetry module may be programmed to detect when an accident is likely to have occurred, for example, by sensing uncontrolled tumbling of the helmet 10 or by sensing an acceleration that exceeds a predetermined g-threshold. The telemetry module and controller 40 may further be operable to apply a severity index to the sensed parameters to determine a likely severity of any injuries that may have occurred to the wearer. Upon receiving a command or detecting that there has been an accident, the system 11 may automatically save the prior 5 minutes (or any time period) of audio or video for future analysis to determine the cause of the accident and to aid in the diagnosis of injuries that may have occurred. The system 11 may also send one or more distress messages to the facility where the activity is being performed, to the wearer's friends, or to local emergency personnel. Distress messages may include, among other things, the identity and location of the wearer, and the likely severity of any injuries. The system 11 may also automatically enable two-way communication between the wearer and any individual contacted by or responding to the distress message.

The helmet 10 may be linked to other, similarly configured helmets 10, to define a group of helmets 10. Wearers of the helmets in the group may thereafter be able to communicate via a private short-range communication network. In addition, the locations of each helmet 10 may be broadcast to the group and the results overlaid on a map of the local area, making it easier to locate members of the group. Display of the map may be provided on a wristwatch display device that wirelessly communicates with the helmet, by the display on the user's smart phone, or via a heads up display provided on the helmet. Such display devices may also enable the system 11 to provide turn-by-turn navigation, and may allow for real-time monitoring of the video being captured by the camera 30. In some embodiments the camera 30 may include micro-actuators that allow the camera 30 to be adjusted (e.g., by panning and/or zooming) within the camera opening 42. Where the helmet 10 has been linked with a group of helmets, the turn-by-turn navigation information and the video display may be broadcast to other helmets in the group.

The above-described scenarios are generally described with respect to a snow helmet for use by a skier or snowboarder. It should be appreciated however that the system can also be used in substantially any other activity where the use of a helmet or other type of headgear is desirable or acceptable. For example, the system 11 installed in and configured for use with a motorcycle helmet. Application and installation of the system 11 in a motorcycle helmet is substantially similar to that of the snow helmet discussed above. Additional features that may be appropriate for the motorcycle application include a lap timer function in which the system 11 broadcasts the wearer's lap times via the speakers 34, and a lap time video overlay function in which the current lap time is overlaid onto the video recorded by the camera 30. Lap times may be started and stopped by a voice command, by a remotely located (e.g., handlebar-mounted) actuation button, or by a timing transponder integrated with or configured to electronically communicate with the controller 40.

These functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks. When the above description refers to the system 11 or the controller 40 performing a function or operating in a particular way, it should be understood that the functions or operations are being performed based on programming instructions stored in memory associated with the system 11 or the controller 40.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, read-only and recordable BLU-RAY™ discs, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "server", "processor", and "memory" all refer to electronic or other technological devices. These terms exclude people or groups of people. For the purposes of the specification, the terms display or displaying means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

To provide for interaction with a user, implementations of the subject matter described in this specification can be implemented on a device having a display device, e.g., televisions or other displays with one or more processors coupled thereto or embedded therein, or other appropriate computing devices that can be used for running an application, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

Implementations of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some implementations, a server transmits data (e.g., an HTML page) to a client device (e.g., for purposes of displaying data to and receiving user input from a user interacting with the client device). Data generated at the client device (e.g., a result of the user interaction) can be received from the client device at the server.

It is understood that any specific order or hierarchy of steps in the processes disclosed is an illustration of exemplary approaches. Based upon design preferences, it is understood that the specific order or hierarchy of steps in the processes may be rearranged, or that some illustrated steps may not be performed. Some of the steps may be performed simultaneously. For example, in certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Headings and subheadings, if any, are used for convenience only and do not limit the subject disclosure.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "example" is used herein to mean "serving as an example or illustration." Any aspect or design described herein as "example" is not necessarily to be construed as preferred or advantageous over other aspects or designs. All structural and functional equivalents to the elements of the various aspects described throughout this disclosure that are known or later come to be known to those of ordinary skill in the art are expressly incorporated herein by reference and are intended to be encompassed by the claims.

The previous description is provided to enable any person skilled in the art to practice the various aspects described herein. Various modifications to these aspects will be readily apparent to those skilled in the art, and the generic principles defined herein may be applied to other aspects. While the specific embodiments have been illustrated and described, numerous modifications come to mind without significantly departing from the spirit of the disclosure, and the scope of protection is only limited by the scope of the accompanying claims.

What is claimed is:

1. A helmet comprising:

a helmet body comprising an energy absorbing layer and an outer shell, the energy absorbing layer formed of at least one of expanded polystyrene and expanded polypropylene: a first opening formed through the outer shell and extending into the energy absorbing layer, the first opening comprising a perimeter;

a first sleeve disposed at least partially within the first opening, the first sleeve comprising:

a first end comprising a first flange coupled to the outer shell and extending beyond the perimeter of the first opening, a second end opposite the first end comprising a base disposed over the energy absorption layer such that the first sleeve extends only partially into the energy absorbing layer and no part of the first sleeve extends through the energy absorbing layer to an inner surface of the helmet body, and an outer surface of the first sleeve comprising a second flange disposed between, and vertically offset from, the first end and the second end and embedded in the energy absorbing layer: and a camera coupled to the first sleeve and exposed through the first opening at a front of the helmet, offset from a longitudinal central axis of the helmet.

2. The helmet of claim 1, wherein the first sleeve comprises a depth greater than a width or a length.

3. The helmet of claim 1, wherein the first flange is directly coupled to an outer surface or an inner surface of the outer shell.

4. The helmet of claim 1, wherein the outer shell and the first sleeve are formed of a single integrally formed piece.

5. The helmet of claim 1, wherein the first sleeve is configured to dissipate energy from an impact sustained by the camera, the first sleeve comprising an outer surface configured to be in contact with an area of the energy absorbing layer, a size and a shape of the area selected to dissipate the energy from the impact by deforming the energy absorption layer without the outer surface of the first sleeve breaking through the energy absorbing layer, the first flange overlapping the outer shell by a distance in a range of 0.5-30 millimeters (mm).

6. The helmet of claim 5, wherein the energy absorbing layer comprises a thickness in a range of 10-50 mm, and wherein the second flange comprises a distance in a range of 0.5-30 mm.

7. The helmet of claim 5, wherein the outer surface of the second flange embedded in the the energy absorbing layer and the second flange is formed as an incline plane spirally circling around the the first sleeve.

* * * * *